US005253883A

United States Patent [19]

Moldenhauer

[11] Patent Number: 5,253,883

[45] Date of Patent: Oct. 19, 1993

[54] PROGRESSIVELY ACTUATED BRAKE FOR A ROLLER SKATE

[75] Inventor: Paul G. Moldenhauer, St. Louis Park, Minn.

[73] Assignee: Rollerblade, Inc., Minneapolis, Minn.

[21] Appl. No.: 4,625

[22] Filed: Jan. 14, 1993

Related U.S. Application Data

[63] Continuation of Ser. No. 714,869, Jun. 13, 1991, abandoned.

[51] Int. Cl.[5] ..... A63C 17/14; B60T 1/14

[52] U.S. Cl. ..... 280/11.2; 188/5; 280/11.22; 280/11.27

[58] Field of Search ..... 188/1.12, 5, 19, 20; 267/152, 153; 280/11.19, 11.20, 11.21, 11.27

[56] References Cited

U.S. PATENT DOCUMENTS

| | | | |
|---|---|---|---|
| D. 292,729 | 11/1987 | Ludwig | D21/226 |
| 805,942 | 11/1905 | Beals . | |
| 2,191,018 | 2/1940 | Ickenroth | 280/11.2 |
| 2,315,342 | 3/1943 | Lieberman | 280/11.2 |
| 2,631,861 | 3/1953 | Daniska | 280/11.2 |
| 2,837,343 | 6/1958 | Serba | 280/11.2 |
| 2,941,812 | 6/1960 | Reynolds | 280/11.2 |
| 3,287,023 | 11/1966 | Ware | 280/11.2 |
| 3,963,251 | 6/1976 | Miano | 280/843 |
| 3,968,973 | 7/1976 | McCormack | 156/78 |
| 4,167,225 | 9/1979 | Fragoso | 280/11.2 |
| 4,334,690 | 6/1982 | Klamer et al. | 280/11.21 |
| 4,417,737 | 11/1988 | Suroff | 280/11.115 |
| 4,909,523 | 3/1990 | Olson | 280/11.2 |
| 5,014,967 | 5/1991 | Wolf et al. | 267/153 |
| 5,046,474 | 9/1991 | Nielsen, Jr. | 156/78 |
| 5,052,701 | 10/1991 | Olson | 280/11.2 |
| 5,067,736 | 11/1991 | Olson et al. | 188/5 |

*Primary Examiner*—Robert J. Oberleitner
*Assistant Examiner*—Chris Schwartz
*Attorney, Agent, or Firm*—Merchant, Gould, Smith, Edell, Welter & Schmidt

[57] ABSTRACT

An in-line roller skate brake having a progressively engagable braking surface and a method for applying such a brake are provided herein. A brake embodying the present invention includes selectively located relief apertures that enable a skater to controllably collapse and deform the brake pad such that the braking surface engages the skating surface from the trailing edge forwardly. In the preferred embodiment, a pair of relief apertures each having a substantially crescent shaped, cross-sectional configuration extend from the braking pad braking surface upwardly into the braking pad. The relief apertures further provide a means for controlling the abrasive wear on the rear portion of the brake pad so that the braking surface will engage the skating surface from the trailing edge forward to the leading edge throughout its use life.

33 Claims, 5 Drawing Sheets

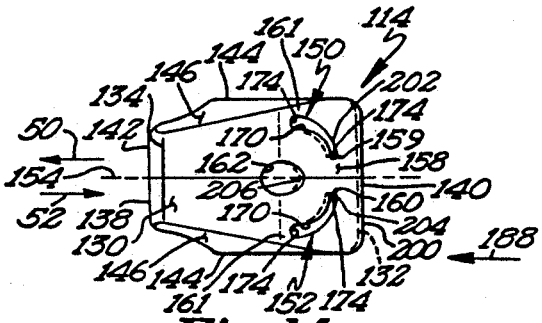
Fig 14
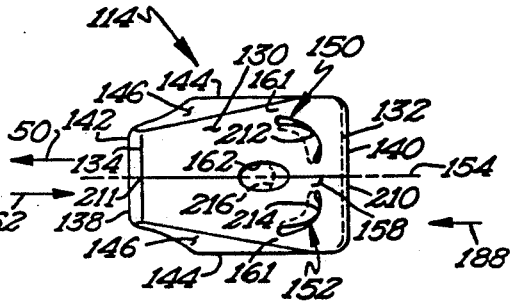
Fig 16
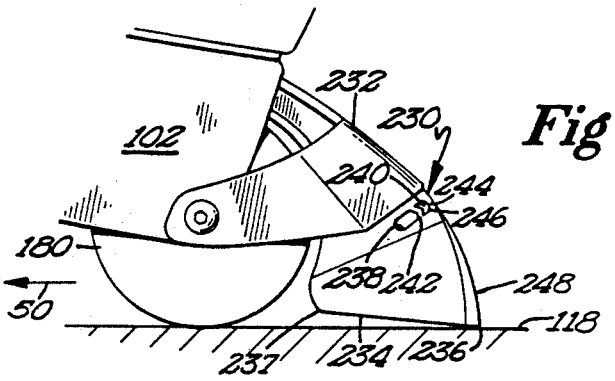
Fig 17
Fig 18
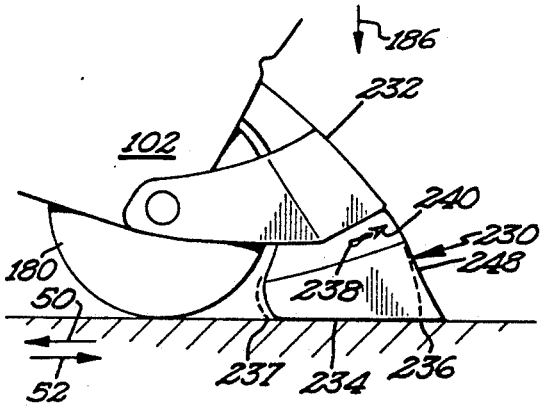

PROGRESSIVELY ACTUATED BRAKE FOR A ROLLER SKATE

This is a continuation, of application Ser. No. 07/714,869, filed Jun. 13, 1991, now abandoned.

The invention relates to a new roller skate brake pad which allows progressive application of the brake to provide improved braking control for the skater.

BACKGROUND OF THE INVENTION

Known roller skate brake pads fall into one of two general classes. Those pads in the first class provide a full facial engagement between the ultimately maximum available pad braking surface and the skating surface from the time of initial brake engagement throughout its life. Pads in the second class are structured such that upon initial brake engagement, only a small portion of the ultimately maximum available braking surface makes contact with the skating surface, and full facial engagement of the ultimately maximum available braking surface with the skating surface is not achieved until substantial brake pad wear has occurred. Full facial engagement of the maximum available braking surface throughout the use life of the pad is generally preferred since it maximizes the amount of braking available to the skater from the first application of the brake until the pad is fully worn out.

With many prior art roller skate brake pads, the contact area between the pad braking surface and the skating surface does not change substantially during braking activity, except for short intervals during a phenomenon which will be called rebound and except for the relatively insubstantial change due to abrasion that actually occurs during braking activity. Thus, except for rebound, the brake is either completely engaged or completely disengaged during use and the ability of the skater to slow down or stop is generally determined by the amount of force the skater is able to bring to bear to urge the pad against the skating surface. When the available braking surface of most pads is totally engaged with the skating surface, rebound can occur, and the skater must act appropriately to prevent or control that rebound and the intermittent interruptions of braking that can come with rebound.

Rebound occurs when the brake is engaged with too much force by the skater and as a result it bounces away from the roadway surface because the skater either has insufficient strength to prevent the bounce or has insufficient skill to control it.

Rebound also occurs when the brake pad undergoes deformation during braking activity. That is, when a skater applies the brake, the brake pad will begin to elastically deform rearwardly upon its engagement with the skating surface due to the frictional forces generated between the engaged surfaces. This deformation takes the form of an outward, rearwardly extending, C-shaped curvature at the trailing edge of the brake pad and, in general, a rearward displacement of that portion of the pad lying near the pad braking surface away from the portions of the brake pad thereabove. During braking, the upper front corner of the pad may be rotated downwardly and stretched away from the brake housing somewhat as braking forces urge the pad rearwardly. As this occurs, the leading edge of the pad tends to rotate rearwardly and become the predominant braking portion of the pad. This causes the leading edge to compress inwardly towards the center of the pad and these compressive forces dominate the applied braking forces. This stretching or deformation will continue until the elastic limit of the brake pad is reached, at which time the pad generally will rebound to its original configuration after first disengaging from the skating surface. Such stretching, disengagement, and rebound may occur several times per second during braking conditions. Prior art brake pads are subject to this elastic rebound type oscillation, the major components of which are the inward compressive forces experienced by the leading edge of the pad, resulting in a diminishing of braking efficiency. Until the present invention, this problem was not recognized and no solution was known.

An associated problem is that while full facial engagement between the pad's braking surface and the riding surface is important for maximum braking efficiency, it is desirable that this maximum engagement with the surface and the resulting immediate onset of full braking not be so abrupt as to de-stabilize the skater. Accordingly, it is desirable to have the brake engage in a manner in which maximum braking force does not occur instantaneously with brake engagement so as to allow a skater, particularly an inexperienced skater, to acclimate himself to the deceleration before it is maximized. Until the present invention, no skate braking system allowed both full facial engagement and gradual braking surface engagement. Gradual braking could only be achieved by the skater cautiously applying the braking surface to the riding surface with carefully controlled amounts of braking force. Such control, however, required experience and was very challenging to inexperienced skaters.

It would be desirable to have a roller skate brake that is less dependent for proper braking upon the strength and experience of the individual skater; that would provide all skaters with greater control over braking; and that would provide a skater with a substantially full facial engagement of the brake pad braking surface with the skating surface throughout the use life of the brake pad while avoiding the effects of abrupt engagement and rebound. Preferably, such a brake should be capable of being retro-fitted to existing brakes and should be useful on both conventional and in-line types of roller skates. The present invention provides an effective solution to these deficiencies in roller skate brakes.

SUMMARY OF THE PRESENT INVENTION

The roller skate brake of the present invention is usable with either a conventional or in-line type of roller skate. The brake includes a brake pad and a brake housing, the housing providing a means for attaching the brake pad to the frame of the skate. The brake pad includes a braking surface that is engageable with the skating surface and that has a substantially planar configuration. The brake pad is mounted to the roller skate and oriented such that the heel or trailing edge of the brake pad makes contact with the skating surface before any other portion of the brake pad.

A brake pad embodying the present invention is structured such that the pad is controllably collapsed or deformed by the skater beginning at the rear of the pad and thence forwardly so as to compress the pad from the rear forwardly, resulting in the progressive, gradually increasing engagement of the pad braking surface from the rear forwardly. The extent of the pad's collapse or deformation and hence the amount of the surface area of the pad braking surface engaged with the skating surface is primarily dependent upon the amount of force applied by the skater, with greater braking occurring as the engaged area of the pad braking surface increases. A brake pad embodying the present invention is not subject to the C-shaped deformation of prior art brakes and is therefore less subject to the earlier described oscillation type of brake pad rebound. Such a pad is also less subject to the bounce-type of rebound since the aforesaid collapse or deformation provides a softer initial contact due to the collapsibility or deformability of the brake pad upon initial contact. The skater can therefore more easily control the amount of braking with a brake pad embodying the present invention because he is able to selectively apply a braking force to the brake pad without a substantial concern of rebound occurring as in prior art brakes.

The brake pad includes means for controllably collapsing or deforming the brake pad. Such means may include selectively located relief apertures extending from the braking surface upwardly into the pad; selectively located relief apertures extending from the rear brake pad surface forwardly into the pad; selectively located relief apertures extending into the pad from the side surfaces of the pad; or by selectively varying the compressibility of the brake pad such that the portions of the pad first engaging the skating surface are more compressible than those that engage the skating surface later.

In a preferred embodiment, a brake pad in accordance with the present invention includes a pair of relief apertures having a substantially crescent shaped cross section disposed symmetrically about the common plane of wheel rotation and extending upwardly into the brake pad from the pad braking surface. The apertures are defined in part by an axis that forms an acute angle with the pad braking surface. The pad is attached to the skate such that the braking surface is disposed at an acute angle to a line drawn substantially tangent to the rearwardmost skate wheel and substantially intersecting the heel or trailing edge of the brake pad, with this angle lying in the range of about three to about five degrees.

With a brake pad embodying the present invention even though the trailing edge of the pad braking surface will engage the skating surface during braking activity when new, the rear of the pad will be abraded relative to the front of the pad during braking activity such that the trailing edge will continue to engage the skating surface before the leading edge throughout its use life. The brake pad allows the forces applied to the pad during braking to predominantly act as rearwardly and outwardly directed stretching forces that stretch the brake pad rearwardly and outwardly rather than acting as rearwardly and inwardly directed compressive forces that compress the front of the pad rearwardly and inwardly. Such a brake pad thereby continues to provide the previously-referred-to known braking advantage of full facial engagement of the brake pad braking surface from its very first application throughout its use life.

These and other advantages of the invention will become apparent to those skilled in the art when the following detailed description of the invention is read in conjunction with the accompanying drawings and claims. Throughout the drawings, like numerals refer to similar or identical parts.

BRIEF DESCRIPTION OF THE DRAWINGS

FIG. 14 is a bottom plan view of the brake pad of FIG. 13 showing the deformation of the brake pad.

FIG. 16 is a bottom plan view of the pad of FIG. 15 showing the stretching of the brake pad braking surface when fully facially engaged.

FIG. 17 is a side elevation view of a brake pad showing a second embodiment of the invention.

FIG. 18 depicts the brake pad of FIG. 17 in operation.

DETAILED DESCRIPTION OF THE PRESENT INVENTION

Figure 1:
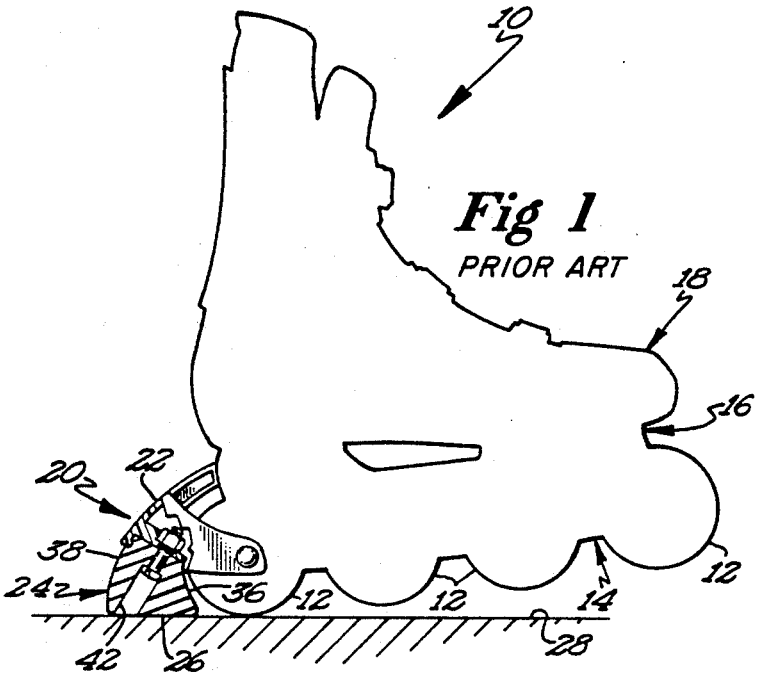
Fig 1 PRIOR ART
FIG. 1 is a side elevation view of a prior art, in-line roller skate showing the skate in outline and the brake in cross section and showing the skate in initial braking position such that the pad braking surface is in full facial engagement with the skating surface.

FIGS. 1–6 illustrate a prior art in-line roller skate and brake and illustrate in exaggerated detail the deformations that their brake pads incur during braking. Referring now to FIG. 1, an in-line roller skate 10 carries a plurality of wheels 12 mounted to a frame 14 for rotation in a common plane. Boot 16 provides a means 16 for attaching the skate frame to the foot and leg of a roller skater. While a boot 16 is preferred, a shoe or other means may be substituted for the boot. Skate 10 further includes a brake 20 which includes a brake housing 22 attached to skate 10 and mounting a brake pad 24 made of rubber or other high friction material and which is brought into contact with the skating surface 28 by rearward pivoting of the skate. The pad 24 has a brake pad braking surface 26 that frictionally engages skating surface 28 in response to such pivoting.

FIG. 1 shows braking surface 26 fully facially engaged with skating surface 28. As previously observed, when prior art skate brakes are engaged, whatever braking surface they have which is capable of bearing against the riding surface is engaged therewith. The brake is either completely on or completely off; that is, the available braking surface capable of braking contact is either engaged or not engaged.

Figure 2:
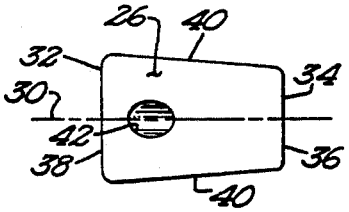
Fig 2 PRIOR ART
FIG. 2 is a bottom plan view of the prior art brake pad of FIG. 1 showing the configuration of the brake pad braking surface in its relaxed state just prior to engagement with the braking surface.

Referring now to FIG. 2, which is a bottom plan view of brake pad 24, braking surface 26 has an elongated configuration symmetrically disposed about a longitudinal axis 30. Axis 30 is thus generally disposed parallel to the longitudinal axis of skate 10. Where skate 10 is an in-line roller skate as shown, longitudinal axis 30 will be co-planar with the common plane of rotation of wheels 12.

Pad braking surface 26 includes a heel or trailing edge 32, generally denoting the rearmost edge of braking surface 26, and a toe or leading edge 34, generally denoting the forwardmost edge of braking surface 26. Pad 24 also includes front and rear surfaces 36 and 38, respectively, and side surfaces 40. The prior art brake pad 24 is attached to brake housing 22 by means of a screw inserted through an access hole 42 in braking surface 26 and extending upwardly through the brake pad, and into engagement with a nut positioned within brake housing 22. A more detailed explanation of this type of attachment of a brake pad to a brake housing can be found in U.S. patent application Ser. No. 07/396,968, filed Aug. 22, 1989, and assigned to the assignee of the present invention.

The deformation and rebound experienced by prior art pad 24 will be discussed with reference to FIGS. 3–6. It is assumed in FIGS. 3–6 that the skate is travelling in a forward direction 50 and that the frictional forces generated between the engaged pad braking surface 26 and skating surface 28 are in rearward direction 52. In FIGS. 3–6, the phantom lines indicate the original or rest position shape of brake pad 24 while the solid lines indicate the engaged position and how the pad is deformed during hard braking operation. It will be understood that the deformations shown in FIGS. 3–6 are exaggerated somewhat to illustrate the discussion herein.

Figure 3:
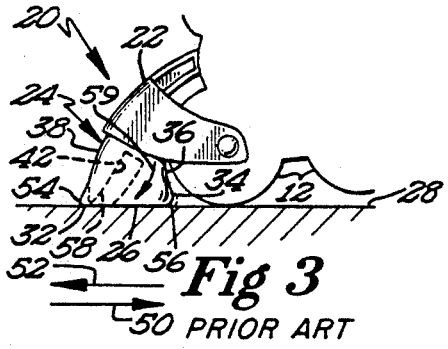
Fig 3 PRIOR ART
FIG. 3 is a side elevation of the prior art in-line skate of FIG. 1 showing in exaggerated detail the rearward deformation of the brake pad during braking.
Figure 4:
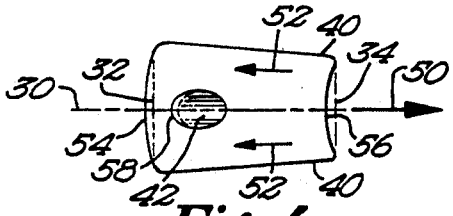
Fig 4 PRIOR ART
FIG. 4 is a bottom plan view of the prior art brake pad of FIG. 3 showing in exaggerated detail the rearward deformation of the pad that occurs during braking.

As shown in FIGS. 3 and 4, upon application of a braking force, frictional engagement between braking surface 26 and skating surface 28 will deform pad 24 rearwardly. As seen in these Figures, rear surface 38 near brake pad heel 32 is stretched and deformed rearwardly such that trailing edge 32 deforms from its previously substantially straight line rest position configuration to a C-shaped configuration 54 (FIG. 4) with that portion of the heel 32 lying along longitudinal axis 30 being deformed the most. Similarly, toe 34 and access hole 42 are deformed rearwardly to deformed positions 56 and 58, respectively. The general shape of the deformation at toe 34 is similar to that experienced by heel 32, that is, a C-shaped rearward deformation with the greatest amount of deformation occurring along longitudinal axis 30. Access hole 42 also experiences a longitudinal deformation due to the rearwardly applied frictional forces 52 resulting in its elongation from the substantially oval rest position configuration shown in FIG. 2. Additionally, as indicated by arrow 59, the pad 24 will tend to rotate rearwardly and underneath itself as leading edge 34 contacts surface 28 and applied forces 52 act to compress the front of the pad rearwardly and inwardly.

Figure 5:
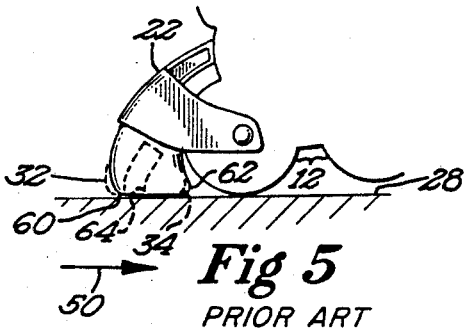
Fig 5 PRIOR ART
FIG. 5 is a partial side elevation view of the rear portion of the in-line skate of FIG. 1 showing in exaggerated detail the prior art brake pad elastically rebounding during braking.
Figure 6:
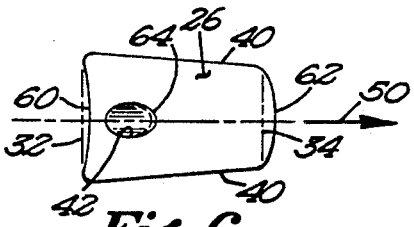
Fig 6 PRIOR ART
FIG. 6 is a bottom plan view of the prior art brake pad in FIG. 5 showing in exaggerated detail the brake pad surface elastically rebounding.
Figure 7:
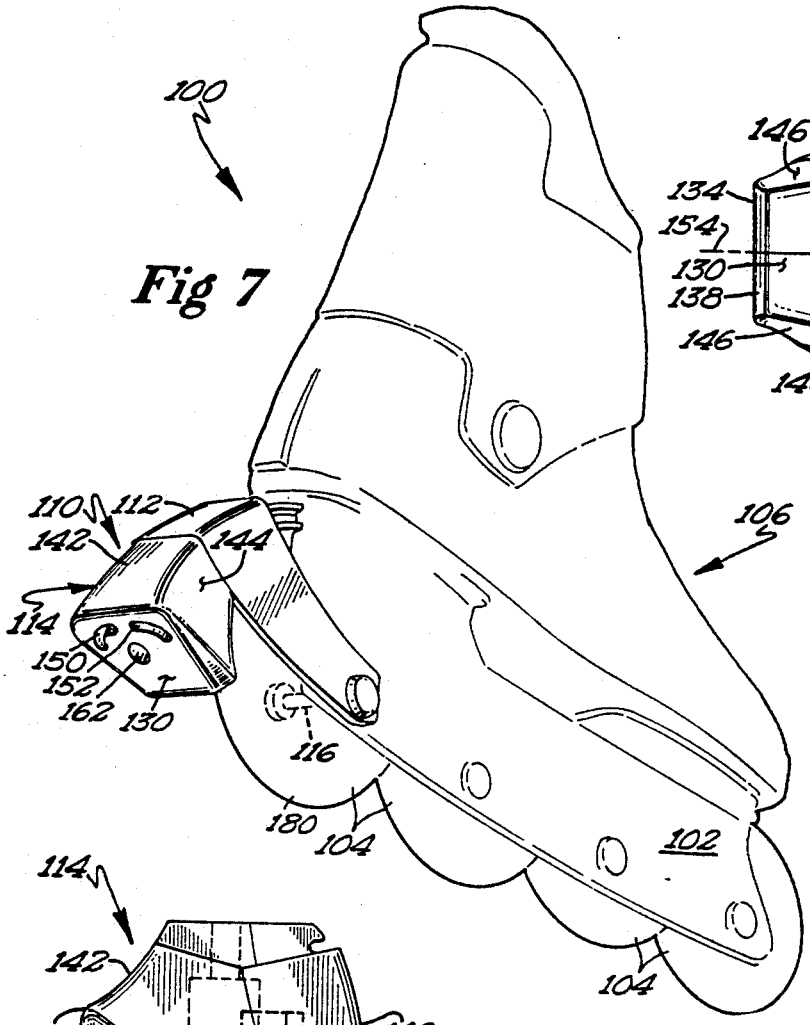
FIG. 7 is a bottom rear perspective view of an in-line roller skate, shown in outline, and illustrating a brake pad embodying the invention.

The deformations shown in FIGS. 3 and 4 will increase with increased frictional forces until a point of compressive saturation and elastic limit is reached and the pad 24 counter-reacts by tearing or rebounding. During rebound the built up forces within the pad caused by its stretching in rearward portions and compression in the forward portions exceed the applied frictional forces and the inherent elasticity of the pad will jerk the pad from its deformed shape shown in FIGS. 3 and 4 back to its original rest position configuration, and somewhat beyond. Thus, FIGS. 5 and 6 show the brake pad 24 after it has rebounded. Again, the deformations shown in these Figures are exaggerated somewhat for purpose of illustration. As seen in the Figures, heel 32, toe 34 and access hole 42 have rebounded to forwardly deformed positions 60, 62, and 64 respectively. The deformed, rebounded configuration of both heel 32 and toe 34 is again C-shaped wherein that part of pad 24 lying along longitudinal axis 30 experiences the most elastic rebound since it was deformed the most. Deformed access hole 42 is again elongated in the manner shown in FIG. 4 except that the elongation is in a forward direction rather than the rearward direction. It should be understood that the forward rebound deformation shown in FIGS. 5 and 6 will generally not be as large as the rearward deformations shown in FIGS. 3 and 4.

FIGS. 1–6 thus illustrate the oscillation of the prior art brake pad about its static position. As noted previously, during pad rebound when the pad snaps back from the positions shown in FIGS. 3 and 4 to those shown in FIGS. 5 and 6 and then back to the skate positions shown in FIGS. 1 and 2, contact may be lost between pad braking surface 26 and skating surface 28, resulting in diminished braking efficiency during this time. While the transition time between the two rebound states is small, it can be bothersome to a skater desiring to stop. This rebounding problem is successfully overcome by the present invention, which will now be described.

FIGS. 7–11 illustrate an in-line roller skate 100 and a brake pad 114 embodying the invention. Skate 100 includes a frame 102 mounting a plurality of wheels 104 for rotation in a common plane. Skate 100 further includes a boot 106, which provides a means for attaching the frame 102 to a skater's lower limb.

Figure 12:
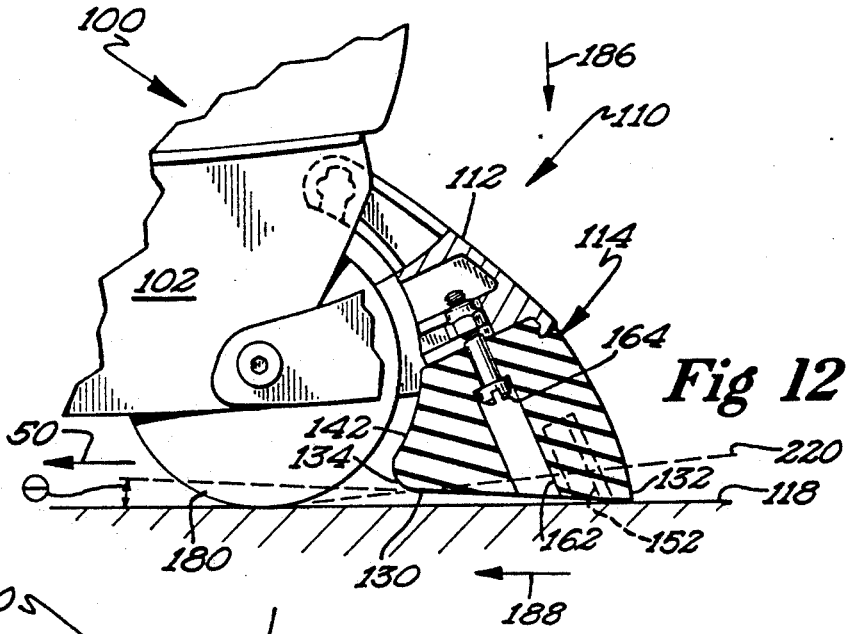
FIG. 12 is a side elevation view taken partly in section and showing an in-line roller skate equipped with the invention and illustrating the position of the brake pad braking surface relative to the skating surface just prior to initial application of the brake.

Skate 100 further includes a brake 110 including brake housing 112, which provides a means for attaching the brake pad 114 to frame 102. The brake pad housing utilizes a bolt and nut as shown in FIG. 12 to attach the pad to the housing and may also utilize various known tongue and groove arrangements to provide additional strength, all of which are within the purview of the invention. If desired, the brake pad housing may be integral with the frame instead of being a separate unit, and such an alternative is within the purview of the invention.

Each wheel 104 is rotatably mounted by an axle 116 to frame 102, and the brake 110 swings downward against the skating surface as the skater pivots the skate about the rearwardmost wheel and its axle 116.

Referring now to FIGS. 7–11, pad 114 has a substantially planar braking surface 130 with trailing edge or heel 132 and leading edge or toe 134. Rear beveled and front rounded beveled surfaces 136 and 138, respectively, extend between heel 132 and rear pad surface 140 and between toe 134 and front pad surface 142. Rounded front edge 138 helps inhibit the front portion of pad 114 from rotating beneath itself, unlike prior art pad 24, and is therefore less subject to the buildup of compressive forces at the front of the skate as a result. Pad 114 further includes a pair of lateral sides 144 and a pair of beveled surfaces 146 that extend between braking surface 130 and sides 144 on each side of pad 114.

Figure 8:
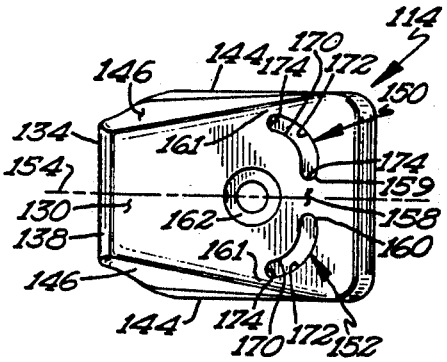
FIG. 8 is a bottom plan view of the brake pad of FIG. 7.
Figure 9:
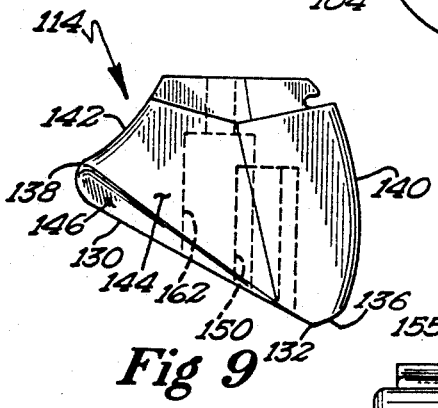
FIG. 9 is a side elevation view of the brake pad of FIG. 7.
Figure 10:
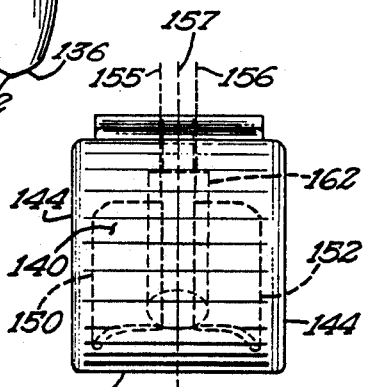
FIG. 10 is a rear plan view of the brake pad of FIG. 7.

As best seen in FIG. 8, a pair of crescent shaped apertures 150 and 152 are positioned on brake surface 130 and disposed symmetrically about a longitudinal axis 154 of pad 114. Axis 154 is co-planar with the common plane of wheel rotation and thus lies along the intersection of the common plane and the braking surface 130. As described in detail below, apertures 150 and 152 enable brake pad 114, particularly the rear portion thereof, to collapse or deform in a controllable manner during braking. Relief apertures 150 and 152 therefore constitute a means for controllably collapsing or deforming brake pad 114 during braking and achieve a progressive engagement of the surface 130 with the skating surface in a rear to forward direction.

Figure 11:
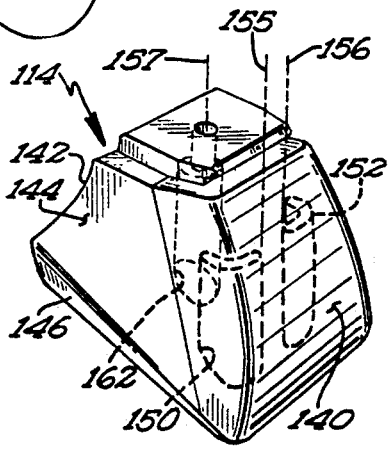
FIG. 11 is a rear top perspective of the brake pad of FIG. 7 showing in phantom outline the configuration of internal relief apertures.

Apertures 150 and 152 are preferably molded as part of the pad and extend upwardly into brake pad 114 at an acute angle, substantially parallel to attachment aperture 162. As measured from braking surface 130 that angle is substantially equal to 63°. Relief apertures 150 and 152 can be defined relative to longitudinal axes 155 and 156, respectively, as illustrated in FIG. 11, which extend generally upright parallel to curved end walls 174. Aperture 162 has an axis 157 with all of said axes 155, 156 and 157 being mutually parallel. Apertures 150 and 152 are separated by a solid rib 158 of brake pad material that extends between edges 159 and 160 of apertures 150 and 152. Each aperture 150, 152 is also separated from surfaces 146 initially, and after some abrasive wear, sides 144, by a rib 161 of pad material. Rib 158 provides support to the central portion of heel 132 to stabilize it during braking activity such that the C-shaped deformation shown in FIGS. 3 and 4 of the prior art skate brakes is substantially avoided, as will be explained hereafter.

As shown in FIGS. 7–11, apertures 150 and 152 each have a crescent-shaped cross sectional configuration, though other configurations are within the purview of the present invention. The exact configuration may vary depending upon the type of material used for the brake as well as the configuration of the pad braking surface. In general, however, when a pad having an elongate configuration is used, the apertures are preferably disposed symmetrically about the longitudinal axis of the pad and in the rearward portion of the brake pad. Furthermore, where the attachment of the pad to the brake housing is made in the manner shown in the Figures, the relief apertures should be disposed rearwardly of the attachment aperture 162. As seen in FIG. 12, pad 114 is attached to housing 112 by a fastener 164 that is inserted into attachment aperture 162 and that engages brake pad housing 112 to attach brake pad 114 firmly thereto.

Referring now to FIGS. 8 and 11, each aperture, such as aperture 150, has a partial annular configuration. That is, aperture 150 is defined in part by inner and outer side walls 170 and 172 respectively, that are joined by curved end walls 174. Inner and outer walls 170 and 172 have a substantially similar curvature centered on substantially the same point, though they may be centered on distinct points if desired. Additionally, the centers of the apertures 150 and 152 ar not coincident in the embodiment shown, though for a different configuration of a braking pad they may be. That is, the centers of the arcs formed by walls 170 and 172 need not, but may be if so desired, the same for apertures 150 and 152.

Referring now to FIGS. 12–16, the operation of the pad 114 during braking activity will be explained. As shown in FIG. 12, skate 100 is in an initial braking position such that heel 132 of pad 114 has made initial engagement with the skating surface 118. Skating surface 118 is tangent to rearwardmost wheel 180 of skate 100, about whose axle or axis of rotation, skate 100 is pivoted to engage the brake. As best seen in FIG. 12, longitudinal axis 154, which lies in the plane of braking surface 130, forms an angle $\theta$ with skating surface 118. The preferred value of the angle $\theta$ is equal to substantially three degrees (3°) but can lie in the range of about three to about five degrees. Thus, during coasting, a line drawn substantially tangent to wheel 180 and substantially intersecting trailing edge 132 of the pad will form an angle with braking surface 130 that lies in the range of about three to five degrees. As can be seen from FIG. 12, engagement of brake pad 114 with skating surface 118 occurs as the skater pivots the skate about the axis of rotation of the rearwardmost wheel. When the skate and brake are new, the skate is pivoted through an angle in the range of about six to thirteen degrees until braking engagement begins at the heel or trailing edge 132 of the brake. To achieve a full facial engagement of the braking surface with the riding surface, the skate is pivoted through a total range of about nine to eighteen degrees. Preferably, the skate should be pivoted through a range of about nine to thirteen degrees (9°–13°) to bring the brake pad into full facial engagement with the skating surface. As the pad 114 wears, the skate will have to be pivoted through a larger angle to achieve trailing edge skating surface engagement; the angle $\theta$ will remain substantially constant throughout the life of the pad, however.

At the level of contact shown in FIG. 12, no collapse, compression or other deformation of brake pad 114 has yet occurred. Thus, a bottom plan view of skate brake pad 114 in the operational position shown in FIG. 12 would look substantially similar to the view shown in FIG. 8. As braking continues, the controlled collapse or deformation of brake pad 114 will begin and engagement will progressively increase until braking pad surface 130 is fully facially engaged with skating surface 118.

Figure 13:
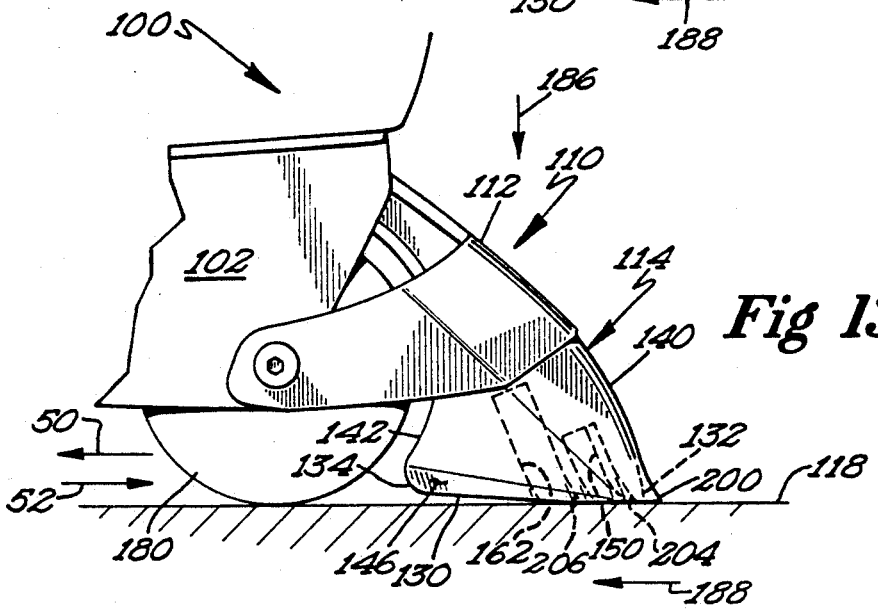
FIG. 13 is a side elevation view of the skate and brake of FIG. 12 wherein as braking engagement begins sufficient force has been applied to the pad such that approximately the rear half of the pad has been compressed as it engages the skating surface.

As shown in FIG. 13, sufficient braking force 186 has been applied to brake 110 by the rotation of skate 100 about rearwardmost wheel 180 to cause brake pad 114 to progressively, partially collapse or deform due to rearwardly directed frictional forces 52. This controlled collapse or deformation results in the rear half of braking surface 130 being facially engaged with skating surface 118. This engagement proceeded from a rear to front, or heel 132 to toe 134 direction as indicated by arrow 188. That is, as progressively greater braking force 186 is applied to brake 110, the amount of braking surface 130 engaging skating surface 118 increases as more of the brake pad braking surface 130 comes into frictional contact with skating surface 118. This progressive engagement occurs because of the controlled collapse or deformation of the rear portion of brake pad 114 provided by relief apertures 150 and 152.

As shown in FIGS. 13 and 14, during braking heel 132 of pad 114 progressively collapses and is deformed rearwardly and upwardly to deformed position 200 by frictional forces 52. Similarly, apertures 150, 152 are deformed rearwardly from their rest positions to a their respective displaced positions 202 and 204. Fastening aperture 162 will experience a similar rearward displacement to position 206 that will be less than that experienced by heel 132 and relief apertures 150 and 152 since less force will be experienced by fastening aperture 162. Ribs 158 and 161 substantially prevents the C-shaped rearward deformation of heel 132, resulting, as best seen in FIG. 14, in displaced heel 200 having a substantially even, linear displacement along its side to side width. That is, relief apertures 150 and 152 and ribs 158 and 161 act as a means that not only allows the rear portion of the pad 114 to collapse or deform but to also elongate substantially uniformly. It should be noted that the drawings figures are shown in somewhat exaggerated detail for illustrative purposes.

The controlled collapse of the rear portion of brake pad 114 due to the presence of apertures 150 and 152 provides substantially the same result as utilizing a brake pad having a varying and increasing density as one progresses forwardly from heel 132 toward toe 134. Thus, the rear portion of pad 114 collapses and deforms more easily since relief apertures 150, 152 allow pad 114 to so deform due to the removal of brake pad material otherwise present. That is, relief apertures 150 and 152 enable the rear portion of pad 114 to flex more easily, thereby serving as relief mechanisms for the forces applied to pad 114 during braking. The use of apertures 150 and 152 and the ribs 158 and 161 substantially reduces the C-shaped deformation and oscillation rebound illustrated in FIGS. 1-6 and experienced by prior art skate brake pads. Thus, these apertures allow the rear portion of the pad to elongate so as to achieve its elastic limit before the pad as a whole reaches its elastic limit. It is this elongation, beginning from the trailing edge 132 of pad 114 and progressing towards leading edge 134, and the avoidance of the compression of the front portion of the pad, which is characteristic of most prior art brakes, that substantially reduces the unwanted rebounding and subsequent oscillation associated with the prior art.

Figure 15:
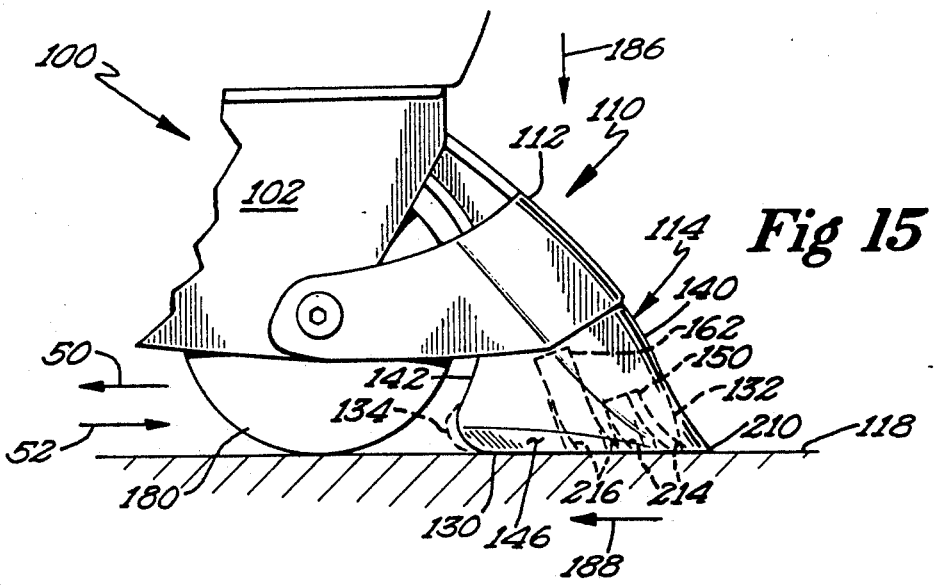
FIG. 15 is a side elevation view showing the pad of FIG. 12 in full facial engagement of the brake pad as a result of the continued compression or deformation of the rear half of the pad.

Referring now to FIGS. 15 and 16, as braking force 186 continues to increase, the braking surface 130 of pad 114 will continue to engage skating surface 118 in a progressive manner from heel 132 forward to toe 134 until substantial full facial engagement occurs as shown in FIGS. 15 and 16. Pad 114 has controllably collapsed such that the entire braking surface 130 is now substantially engaged with skating surface 118. Heel 132 has moved from its rest position to displaced position 210 while toe 134 has been moved to its displaced position 211 in response to full application of the braking force and full facial engagement has occurred between the braking surface 130 and the surface 188. Similarly, apertures 150 and 152 have been displaced rearwardly from their rest positions shown in FIG. 8 to their full facial engagement displaced positions 212 and 214, respectively.

Fastening aperture 162 is also displaced from its position shown in FIG. 8 to its full facial engagement displaced position 216. Like the displacement shown in FIGS. 13 and 14, the displacements 210, 212, 214 and 216 of trailing edge 132, apertures 150, 152 and attachment aperture 162, respectively, are rearwardly of the rest positions. In addition, the displacement of each feature is greatest at the braking surface 130 and decreases in amount as one moves along the axes 155, 156 upwardly through the brake pad. That is, for example, apertures 150 and 152 show the greatest deformation where they intersect braking surface 130 and a diminishing deformation as one proceeds upwardly into the brake pad.

FIGS. 12-16 illustrate the progressive engagement of the brake pad brake surface 130 with skating surface 118. The engagement proceeds from rear to front, i.e., from trailing edge 132 to leading edge 134, as the fractional portion of braking surface 130 engaged with skating surface 118 increases progressively from zero percent to one hundred percent.

As shown in FIGS. 12-16, the relief aperture of the brake provide a means for rotating trailing edge 132 through a greater angle than leading edge 134 relative to its attachment to the skate so that full facial engagement of the pad's braking surface occurs. Prior art skate brakes are constructed such that the rotation of the leading and trailing edge is substantially equal. The greater rotatability of the heel 132 provided by a skate brake embodying the present invention enables the skater to achieve a progressive engagement of the pad's braking surface 130 with skating surface 118 as the brake is applied.

Referring again to FIG. 12, if a prior art brake pad such as pad 24 was substituted for pad 114, the heel 32 of pad 24 would engage the surface first just as heel 132 of pad 114 does but further engagement of the braking surface 26 of pad 24 would not occur until substantial wear had occurred on pad 24. Full facial engagement would not occur until pad 24 had worn enough that its functioning braking surface, that is the worn away surface, would be substantially parallel to a tangent line drawn between wheel 180 and the toe 34 of pad 24. This worn braking surface and its tangent line is indicated by phantom line 220 in FIG. 12. Thus, the present invention as embodied in pad 114 provides a full facial engagement and thus full braking ability to a skater from its very first use even though pad 114 is attached to in-line roller skate 110 such that heel 132 thereof touches the skating surface 118 first when a braking force 186 is applied and even though the braking surface 130 is disposed at the angle $\theta$. The invention thus provides the advantage of achieving both progressive and full engagement braking ability for a braking pad during its full use-life whereas prior art braking pads were incapable of doing so.

A further advantage of pad 114 is that even though heel 132 thereof touches skating surface 118 first during braking, pad 114 will wear during its lifetime such that the heel 132 will strike the skating surface 118 first substantially throughout the lifetime of pad 114 whereas prior art pads will wear until their braking surface is tangent to the rearwardmost wheel. The prior art brakes, once fully broken in, always have immediate full facial engagement of the available braking surface and will strike the skating surface with all portions of the available braking surface substantially simultaneously. Relief apertures 150, 152 therefore further function as a means for controlling abrasive wear on the rear portion of braking surface 130 relative to the front portion thereof so as to maintain the angle $\theta$ substantially within the aforementioned range.

By its collapsible, deformable nature then, brake pad 114 provides a skater with an improved and better control of braking activity. The progressive engagement of the braking surface enables a skater to exercise greater control over the amount of braking at any particular point in time and allows him, with only a modest amount of braking ability, to vary the braking from a small amount to a full facial engagement and full braking potential. With prior art skates, such as that shown in FIGS. 1–6, the skater had to either have the brake fully facially engaged or not engaged. While full facial engagement provides the greatest amount of braking, it takes greater skill to use properly than the brake of the present invention.

As previously mentioned, pad 114 includes side beveled surfaces 146. To provide maximum braking, it is desirable to maximize the area of braking surface 130. In theory, this could be done by making pad 114 longer or wider or both. It is not possible, however, to widen pad 114 to any large extent since the pad would drag when a skater was cornering and would subject the skater to unwanted braking when cornering. Creation of beveled surfaces 146 thereby creates cornering clearance by reducing pad width. In the embodiment shown, the area of braking surface 130 in its new condition is about 2.7 square inches. After pad 130 has been subjected to braking for some time, the beveled area will have been abraded away, resulting in a larger braking surface area of about 3.1 square inches. Different magnitudes of the areas for braking surface 130 are within the purview of the present invention; however, such pad braking surfaces should be within a range of about 2.0 square inches to about 3.5 square inches. The cross sectional area of the relief apertures preferably is in the range of about 0.1 square inches to about 0.15 square inches.

Thus, in the embodiment shown, the ratio of the braking surface area to the relief aperture area is approximately 19:1. Preferably, this ratio should lie in a range of about 16:1 to about 26:1. Furthermore, full facial engagement of the braking surface 130 should occur before the braking force 186 reaches a maximum of 75 pounds and preferably when the braking force is within a range of about 50 to 75 pounds. With a braking surface area in the range of about 2.0 square inches to about 3.5 square inches, the ratio of the maximum applied braking force 186 needed to achieve full facial engagement to the braking surface area should range from about 14 pounds per square inch to about 37.5 pounds per square inch. The brake pad 114 is preferably made out of a rubber having a hardness or durometer ratings of about 90, though materials having a durometer ratings in the range of about 85 to 95 are within the purview of the present invention. Thus, the ratio of the maximum braking force to the pad durometer rating will preferably range from about 0.52 to about 0.88.

Figure 19:
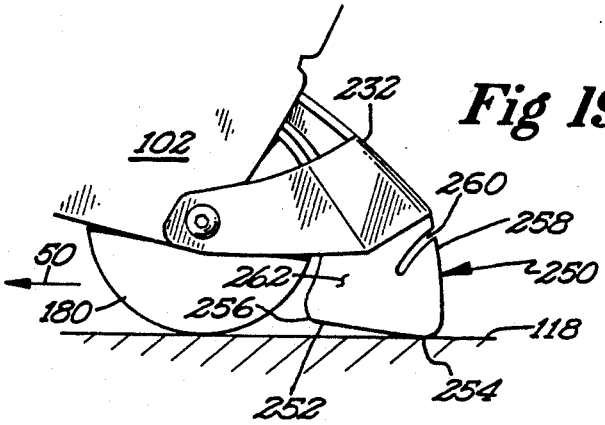
FIG. 19 is a side elevation view of a brake pad showing a third alternative embodiment of the invention.
Figure 20:
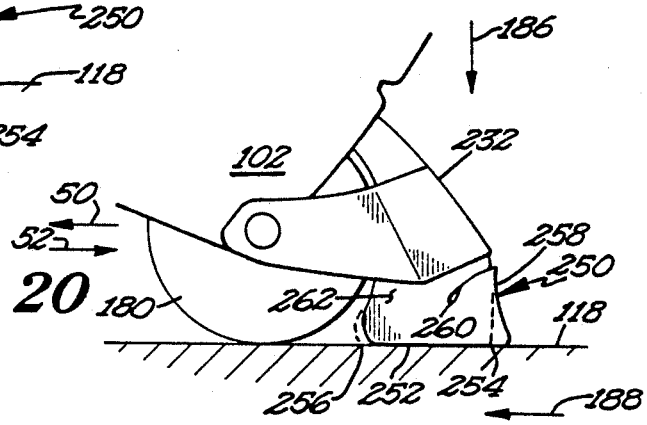
FIG. 20 depicts the brake pad of FIG. 19 in operation.
Figure 21:
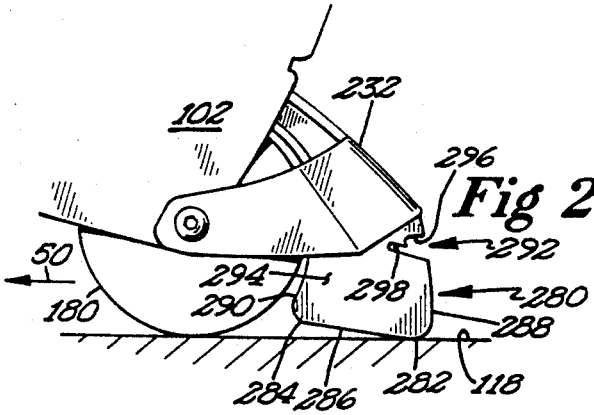
FIG. 21 is a side elevation view of a brake pad showing a fourth embodiment of the invention.
Figure 22:
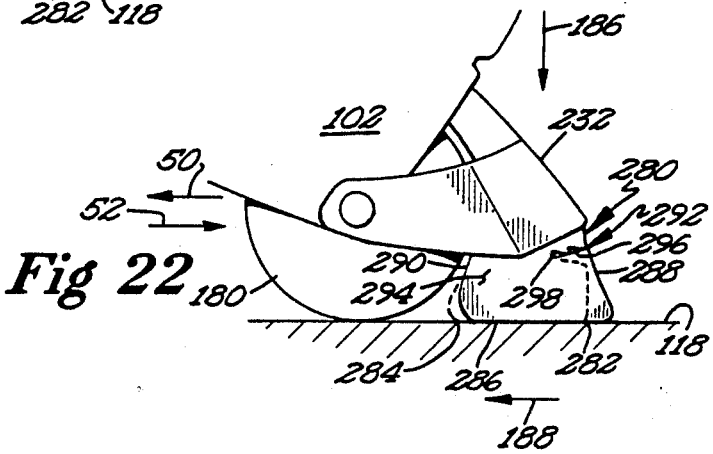
FIG. 22 depicts the brake pad of FIG. 21 during operation.

Alternative embodiments to the brake pad 114 are shown in FIGS. 17, 19 and 21 and their respective operational, fully facially engaged positions are shown in FIGS. 18, 20 and 22. Each of the embodiments shown in FIGS. 17, 19 and 21 include at least one relief aperture in the rear upper portion of the brake pad that extend inwardly into the pad from the side wall, rather than upwardly into the pad from the braking surface as with the previous embodiment, pad 114. As shown in the Figures, the relief apertures extend completely through the pad from one side wall to the other side wall though corresponding pairs of relief apertures similarly situated that extend into the pad from opposite side walls and that are separated by a narrow rib of pad material are within the purview of the present invention.

Thus as seen in FIG. 17, an alternative embodiment of the present invention includes a brake pad 230 mounted by a brake housing 232 to skate 100. Pad 230 has a braking surface 234 disposed at an angle substantially equal to three degrees with respect to a tangent line drawn between wheel 180 and intersecting the heel 236 of pad 230. In the upper rear portion of the pad, a pair of relief apertures 238 and 240 extend through pad 230 between the side walls of pad 230. Pad 230 further includes a toe 237 Aperture 238 has a substantially oval configuration while aperture 240 has a configuration of a semi-oval. A narrow rib 242 of brake pad material separates aperture 238 from aperture 240. In addition, a narrow rib 244 of material separates the outermost edge 246 of aperture 240 from the rear surface 248 of pad 230.

FIG. 18 shows brake pad 230 fully facially engaged with skating surface 118, such engagement having resulted in the rearward deformation of rear surface 248 from its original position shown in dotted line to the deformed position shown in full line. Additionally, the application of the braking force 186 has resulted in the collapse of the rear portion of the braking pad 230 with respect to the front portion such that apertures 238 and 240 are collapsed substantially to the configuration shown in FIG. 18. As with brake pad 114 and its relief apertures 150, 152, brake pad 230 and its relief apertures 238 and 240 provide for the controlled collapse and deformation of the rear portion of the brake pad 230 with respect to the front portion, resulting in the progressive engagement of the brake pad from the heel 236 of the brake forwardly until full facial engagement of the brake pad occurs with the skating surface 118. It should be understood that in reaching such full facial engagement, the braking surface passes through a transition position similar to that shown in FIG. 15 with respect to the first embodiment.

FIG. 19 illustrates another embodiment of the invention wherein a brake pad 250 having a braking surface 252, a heel 254, a toe 256, and a rear surface 258 includes a relief apertures 260, here shown as a slot, that extends through pad 250 between the side walls 262 of the pad 250 and which extends to and opens on rear surface 258. Slot 260 has a slight curved configuration but extends generally downwardly from rear surface 258 towards braking surface 252.

FIG. 20 shows brake pad 250 and its braking surface 252 fully engaged with skating surface 118 and shows slot 260 collapsed. As with the previous embodiments, the collapse of slot 260 facilitates a controlled deformation of the rear portion of pad 250 such that the engagement of braking surface 250 begins at heel 254 and proceeds progressively to toe 256, passing through a transition position similar to that shown in FIG. 15 with respect to the first embodiment.

A third embodiment of the invention is shown in FIG. 21 wherein a brake pad 280 has a heel 282 and a toe 284 respectively defining the trailing and leading edges of a braking surface 286. The pad has rear and front walls 288 and 290, respectively, and includes a relief aperture 292 extending between side walls 294 of pad 280 and extending in and opening on rear surface 288. Braking surface 286 like the previous embodiments is disposed such that heel 282 strikes the skating surface 118 before toe 284. Aperture 292 has a complex configuration defined by a semi-oval cross section channel 296 extending inwardly into pad 280 from rear surface 288 and a substantially horizontally disposed rectangular slot 298 extending rearwardly from the bottom portion of channel 296.

FIG. 22 shows the brake pad 280 in full facial engagement with skating surface 118 during braking. Aperture 292 has partially collapsed allowing the full facial engagement to occur. Thus, as pad 280 is applied at the beginning of braking activity, heel 282 strikes the skating surface 118 first and the progressive rear to front engagement of braking surface 286 begins and continues until the fully facially engaged position shown in FIG. 122 occurs. Thus, this brake, like those of the other embodiments shown, also goes through a transition stage such as that shown in FIG. 15 wherein only a portion of the total available braking surface is engaged at a particular point in time during the braking activity. As with the other embodiments, the collapse of aperture 292 and deformation of pad 280 allows the skater to controllably apply the brake pad 280 to the skating surface 118 so a to achieve the desired amount of braking, thus achieving the same advantages as the embodiments shown in FIGS. 7–17. Relief apertures 150 and 152; 230 and 248; 260; and 292 are all means for providing a controlled collapse of the rear portion of a brake pad relative to the front portion of the brake pad and an overall pad deformation of the brake pad in order to achieve a controlled progressive engagement of the braking surface of the pad with the skating surface. The controlled collapse of each of the apertures results in the rear portion of the pad absorbing less of the skating generated braking forces during braking activities such that they will wear at a substantially equal rate with that of the front portions. Thus, the braking surface of the pad will always be disposed at substantially the same angle as when first attached to the skate.

While each of the embodiments of the invention shown in FIGS. 7–22 provide for the controlled collapse and deformation of the rear portion of the brake pad, the embodiment shown in FIGS. 7–16 does so slightly differently than the three embodiments shown in FIGS. 17–22. Thus, with the former embodiment the rear brake pad portion engages in a more rearwardly than upwardly collapse and deformation because of the relief apertures 150 and 152 that extend in a generally upright direction into the pad 114. The relief apertures 150 and 152 allow a rearward displacement of the pad preferential to an upward displacement. The latter embodiments, pads 230, 250, and 280, have relief apertures 238 and 240; 260; and 292, respectively, that enable the pads to collapse and deform in a more upwardly than rearwardly direction.

The present invention having thus been described, other modifications, alterations, or substitutions may now suggest themselves to those skilled in the art, all of which are within the spirit and scope of the present invention. It is therefore intended that the present invention be limited only by the scope of the attached claims below.

I claim:

1. A brake and an in-line roller skate, the skate being useable by a skater on a skating surface and including a frame mounting a plurality of wheels in a common plane of rotation and further including means for attaching the frame to a skater's foot, said brake being engaged upon the skating surface by the skater pivoting the skate rearwardly and downwardly about the rearwardmost of the wheels to apply a braking force, said brake comprising:

a brake pad formed of at least one compressible material and including front and rear portions, said brake pad further including a braking surface disposed substantially transversely to said common plane and engageable with the skating surface as the skate is pivoted about the rearwardmost wheel, said brake pad braking surface further including leading and trailing edges; and means for attaching said brake pad to the skate rearwardly of the rearwardmost wheel such that said trailing edge engages the skating surface before said leading edge when said brake is applied;

wherein said pad further includes means for abating rebound and oscillation of the brake pad as the brake is applied; and said means for abating comprises a pair of relief apertures extending upwardly into said pad from said braking surface.

2. A brake and an in-line roller skate, the skate being useable by a skater on a skating surface and including a frame for mounting a plurality of wheels in a common plane of rotation and further including means for attaching the frame to a skater's foot, said brake being engagable with the skating surface by pivoting of the skater's foot about the rearwardmost of the wheels to apply a braking force, said brake comprising:

a brake pad formed of at least one compressible material and including front and rear portions, said brake pad further including a braking surface having an area engageable with the skating surface as the skate is pivoted about the rearwardmost wheel, said brake pad braking surface including leading and trailing edges;

means for attaching said brake pad to the skate rearwardly of the rearwardmost wheel such that said trailing edge engages the skating surface before said leading edge when said brake is applied;

said pad further including means for controllably deforming said rear brake pad portion rearwardly in response to the applied braking force so as to progressively engage the braking surface with the skating surface so as to avoid de-stabilizing the skater; and said means for controllably deforming said rear brake pad portion comprising a pair of relief apertures extending upwardly into said pad from said braking surface.

3. The brake of claim 2 wherein said apertures are disposed symmetrically with respect to the common plane of rotation.

4. The brake of claim 3 wherein said relief apertures each have a crescent shaped cross-sectional configuration.

5. A brake and an in-line roller skate, the skate being useable by a skater on a skating surface and including a frame mounting a plurality of wheels in a common plane of rotation and further including means for attaching the frame to a skater's foot, said brake being engaged with the skating surface by the skater pivoting the skater rearwardly and downwardly about the rearwardmost of the wheels to apply a braking force, said brake comprising:

a brake pad formed of at least one compressible material and including front and rear portions, said brake pad further including a braking surface disposed substantially transversely to said common plane and engageable with the skating surface as the skate is pivoted about the rearwardmost wheel, said brake pad braking surface further including leading and trailing edges;

means for attaching said brake pad to the skate rearwardly of the rearwardmost wheel such that said trailing edge engages the skating surface before said leading edge when said brake is applied;

wherein said pad further includes means for abating rebound and oscillation of the brake pad as the brake is applied; and said pad has a rear wall and said means for abating comprises a slot extending through said brake pad transverse to the common plane of rotation, said slot beginning in said rear wall and extending inwardly into said brake pad.

6. A brake and an in-line roller skate, the skate being useable by a skater on a skating surface and including a frame mounting a plurality of wheels in a common plane of rotation and further including means for attaching the frame to a skater's foot, said brake being engaged upon the skating surface by the skater pivoting the skate rearwardly and downwardly about the rearwardmost of the wheels to apply a braking force, said brake comprising:

a brake pad formed of at least one compressible material and including front and rear portions, said brake pad further including a braking surface disposed substantially transversely to said common plane and engageable with the skating surface as the skate is pivoted about the rearwardmost wheel, said brake pad braking surface further including leading and trailing edges; and means for attaching said brake pad to the skate rearwardly of the rearwardmost wheel such that said trailing edge engages the skating surface before said leading edge when said brake is applied;

wherein said pad further includes means for abating rebound and oscillation of the brake pad as the brake is applied; and said rear pad portion includes a rear upper portion and said means for abating comprises at least one relief aperture extending into said pad and transverse to said common plane of rotation, said relief aperture being disposed in said pad in said rear upper portion thereof.

7. The brake of claim 6 wherein at least one relief aperture extends through said pad.

8. A brake and an in-line roller skate, the skate useable by a skater on a skating surface and including a frame for mounting a plurality of wheels in a common plane of rotation and further including means for attaching the frame to a skater's foot, said brake being engagable with the skating surface by pivoting of the skater's foot about the rearwardmost of the wheels to apply a braking force, said brake comprising:

a brake pad formed of at least one compressible material and including front and rear portions, said brake pad further including a braking surface having an area engageable with the skating surface as the skate is pivoted about the rearwardmost wheel, said brake pad braking surface including leading and trailing edges;

means for attaching said brake pad to the skate rearwardly of the rearwardmost wheel such that said trailing edge engages the skating surface before said leading edge when said brake is applied;

said pad further including means for controllably deforming said rear brake pad portion rearwardly in response to the applied braking force so as to progressively engage the braking surface with the skating surface so as to avoid de-stabilizing the skater; and said pad has a rear wall and said means for controllably deforming said rear brake pad portion comprising a slot extending through said pad transverse to said common plane, said slot beginning in said rear wall and extending inwardly into said pad.

9. The brake of claim 8 wherein during coasting said braking surface and a line drawn substantially tangent to said rearwardmost wheel and substantially intersecting said trailing edge of said brake pad form an angle in the range of about three to five degrees.

10. A brake and an in-line roller skate, the skate useable by a skater on a skating surface and including a frame for mounting a plurality of wheels in a common plane of rotation and further including means for attaching the frame to a skater's foot, said brake being engagable with the skating surface by pivoting of the skater's foot about the rearwardmost of the wheels to apply a braking force, said brake comprising:

a brake pad formed of at least one compressible material and including front and rear portions, said brake pad further including a braking surface having an area engageable with the skating surface as the skate is pivoted about the rearwardmost wheel, said brake pad braking surface including leading and trailing edges;

means for attaching said brake pad to the skate rearwardly of the rearwardmost wheel such that said trailing edge engages the skating surface before said leading edge when said brake is applied;

said pad further including means for controllably deforming said rear brake pad portion rearwardly in response to the applied braking force so as to progressively engage the braking surface with the skating surface so as to avoid de-stabilizing the skater; and said brake pad rear portion includes a rearward upper portion and said means for controllably deforming said rear brake pad portion comprises at least one relief aperture extending through said pad transverse to said common plane, said aperture being disposed in said pad in the rearward upper portion thereof.

11. The brake of claim 10 wherein said at least one relief aperture extends through said pad.

12. The brake of claim 11 wherein said means for controllably deforming said rear brake pad portion comprises a pair of said relief apertures.

13. The brake of claim 12 wherein one of said apertures has a substantially oval configuration and the other one of said apertures has a substantially semi-oval configuration.

14. A brake and an in-line roller skate, the skate being useable by a skater on a skating surface and including a frame mounting a plurality of wheels in a common plane of rotation and further including means for attaching the frame to a skater's foot, said brake being engaged upon the skating surface by the skater pivoting the skate rearwardly and downwardly about the rearwardmost of the wheels to apply a braking force, said brake comprising:

a brake pad formed of at least one compressible material and including front and rear portions, said brake pad further including a braking surface disposed substantially transversely to said common plane and engageable with the skating surface as the skate is pivoted about the rearwardmost wheel, said brake pad braking surface further including leading and trailing edges; and means for attaching said brake pad to the skate rearwardly of the rearwardmost wheel such that said trailing edge engages the skating surface before said leading edge when said brake is applied;

said pad further including means for controllably collapsing said rear portion of said brake as increasing braking force is applied to said brake by the skater, said collapsing rear portion resulting in the progressive rear to front engagement of said braking surface with the skating surface as said force is increased until said braking surface substantially fully facially engages said skating surface; and said means for controllably collapsing said rear portion of said brake pad comprising a pair of relief apertures extending upwardly into said pad from said braking surface.

15. The brake of claim 14 wherein said relief apertures are disposed symmetrically with respect to the common plane of rotation and are spaced apart to provide a central rib of pad material therebetween to stabilize said trailing edge of said brake pad braking surface.

16. The brake of claim 14 wherein each said relief aperture has a crescent shaped cross-sectional configuration.

17. The brake of claim 14 wherein during coasting said braking surface and a line drawn substantially tangent to said rearwardmost wheel and substantially intersecting said trailing edge of said brake pad braking surface form an angle in the range of about three to five degrees.

18. A brake and an in-line roller skate, the skate being useable by a skater on a skating surface and including a frame mounting a plurality of wheels in a common plane of rotation and further including means for attaching the frame to a skater's foot, said brake being engaged upon the skating surface by the skater pivoting the skate rearwardly and downwardly about the rearwardmost of the wheels to apply a braking force, said brake comprising:

a brake pad formed of at least one compressible material and including front and rear portions, said brake pad further including a braking surface disposed substantially transversely to said common plane and engageable with the skating surface as the skate is pivoted about the rearwardmost wheel, said brake pad braking surface further including leading and trailing edges; and means for attaching said brake pad to the skate rearwardly of the rearwardmost wheel such that said trailing edge engages the skating surface before said leading edge when said brake is applied;

said pad further including means for controllably collapsing said rear portion of said brake as increasing braking force is applied to said brake by the skater, said collapsing rear portion resulting in the progressive rear to front engagement of said braking surface with the skating surface as said force is increased until said braking surface substantially fully facially engages said skating surface; and said pad has a rear wall and said means for controllably collapsing said rear portion of said brake pad comprising a slot extending through said brake pad transverse to the common plane of rotation, said slot beginning in said rear wall and extending inwardly into said brake pad.

19. The brake of claim 18 wherein during coasting said braking surface and a line drawn substantially tangent to said rearwardmost wheel and substantially intersecting said rear edge of said brake pad braking surface form an angle in the range of about three to five degrees.

20. A brake and an in-line roller skate, the skate being useable by a skater on a skating surface and including a frame mounting a plurality of wheels in a common plane of rotation and further including means for attaching the frame to a skater's foot, said brake being engaged upon the skating surface by the skater pivoting the skate rearwardly and downwardly about the rearwardmost of the wheels to apply a braking force, said brake comprising:

a brake pad formed of at least one compressible material and including front and rear portions, said brake pad further including a braking surface disposed substantially transversely to said common plane and engageable with the skating surface as the skate is pivoted about the rearwardmost wheel, said brake pad braking surface further including leading and trailing edges; and means for attaching said brake pad to the skate rearwardly of the rearwardmost wheel such that said trailing edge engages the skating surface before said leading edge when said brake is applied;

said pad further including means for controllably collapsing said rear portion of said brake as increasing braking force is applied to said brake by the skater, said collapsing rear portion resulting in the progressive rear to front engagement of said braking surface with the skating surface as said force is increased until said braking surface substantially fully facially engages said skating surface; and said rear pad portion includes a rear upper portion and wherein said means for controllably collapsing said rear portion of said brake pad comprising at least one relief apertures extending into said pad and transverse to said common plane of rotation, said relief aperture being disposed in said pad in said rear upper portion thereof.

21. The brake of claim 20 wherein said at least one relief aperture extends through said pad.

22. The brake of claim 21 wherein said means for controllably collapsing said rear portion of said brake pad comprises a pair of said relief apertures.

23. The brake of claim 22 wherein one of said relief apertures has a substantially oval cross-sectional configuration and the other one of said apertures has a substantially semi-oval cross-sectional configuration.

24. The brake of claim 21 wherein during coasting said braking surface and a line drawn substantially tangent to said rearwardmost wheel and substantially intersecting said trailing edge of said brake pad braking surface form an angle in the range of about three to five degrees.

25. A brake and an in-line roller skate, the skate being useable by a skater on a skating surface and including a frame mounting a plurality of wheels in a common plane of rotation and further including means for attaching the frame to a skater's foot, said brake being engaged upon the skating surface by the skater pivoting the skate rearwardly and downwardly about the rearwardmost of the wheels to apply a braking force, said brake comprising:

a brake pad formed of at least one compressible material, said brake pad further including a braking surface engageable with the skating surface as said skate is pivoted about the rearwardmost wheel, said braking surface including a leading edge and a trailing edge; and attaching means for attaching said brake pad to the skate rearwardly of the rearwardmost wheel such that said trailing edge engages the skating surface before said leading edge when said brake is applied;

wherein during braking, said engagement of said brake pad with the skating surface begins at said trailing edge of said brake pad braking surface upon the initial application of the braking force as the skate is pivoted, and wherein the fractional portion of said braking surface engaging the skating surface progressively increases from the trailing edge to the leading edge as the skate is further pivoted and the applied braking force is increased until said pad braking surface substantially fully facially engages the skating surface;

wherein said brake pad braking surface is fully facially engageable with the skating surface both when said pad is new and as said pad becomes worn;

said pad further includes a rear pad portion and a pair of relief apertures extending upwardly into said pad from said braking surface, said relief apertures being disposed in said rear pad portion, said relief apertures being provided to controllably collapse and deform said brake pad during braking surface with the skating surface and assure that said rear pad portion abrades more slowly than said front pad portion so that said pad braking surface progressively engages the skating surface beginning with said trailing edge during braking substantially throughout the use-life of said pad.

26. A brake and an in-line roller skate, the skate being useable by a skater on a skating surface and including a frame mounting a plurality of wheels in a common plane of rotation and further including means for attaching the frame to a skater's foot, said brake being engaged upon the skating surface by the skater pivoting the skate about the rearwardmost of the wheels to engage the skating surface so as to apply a braking force, said brake comprising:

a brake pad formed of at least one compressible material, said brake pad further including a braking surface engageable with the skating surface as said skate is pivoted about the rearwardmost wheel, said braking surface including a leading edge and a trailing edge; and attaching means for attaching said brake pad to the skate rearwardly of the rearwardmost wheel such that said trailing edge engages the skating surface before said leading edge when said brake is applied;

wherein during braking, said engagement of said brake pad with the skating surface begins at said trailing edge of said brake pad braking surface upon the initial application of the braking force as the skate is pivoted, and wherein the fractional portion of said braking surface engaging the skating surface progressively increases from the trailing edge to the leading edge as the skate is further pivoted and the applied braking force is increased until said pad braking surface substantially fully facially engages the skating surface;

wherein said brake pad braking surface is fully facially engageable with the skating surface both when said pad is new and as said pad becomes worn;

said break pad including front and rear pad portions and further includes control means for controlling abrasive wear of said pad during operation, said control means being disposed at said rear pad portion such that said rear pad portion abrades relative to said front pad portion so that said pad braking surface progressively engage the skating surface from said trailing edge to said leading edge during braking substantially throughout the use-life of said pad; and said pad has a rear wall and said means for controlling abrasive wear comprises a slot extending through said pad transverse to said common plane of rotation, said slot beginning in said rear wall and extending inwardly into said pad.

27. The brake of claim 26 wherein during coasting said braking surface and a line drawn substantially tangent to said rearwardmost wheel and substantially intersecting said trailing edge of said brake pad form an angle in the range of about three to five degrees.

28. A brake and an in-line roller skate, the skate being useable by a skater on a skating surface and including a frame mounting a plurality of wheels in a common plane of rotation and further including means for attaching the frame to a skater's foot, said brake being engaged upon the skating surface by the skater pivoting the skate about the rearwardmost of the wheels to engage the skating surface so as to apply a braking force, said brake comprising:

a brake pad formed of at least one compressible material, said brake pad further including a braking surface engageable with the skating surface as said skate is pivoted about the rearwardmost wheel, said braking surface including a leading edge and a trailing edge; and attaching means for attaching said brake pad to the skate rearwardly of the rearwardmost wheel such that said trailing edge engages the skating surface before said leading edge when said brake is applied;

wherein during braking, said engagement of said brake pad with the skating surface begins at said trailing edge of said brake pad braking surface upon the initial application of the braking force as the skate is pivoted, and wherein the fractional portion of said braking surface engaging the skating surface progressively increases from the trailing edge to the leading edge as the skate is further pivoted and the applied braking force is increased until said pad braking surface substantially fully facially engages the skating surface;

wherein said brake pad braking surface is fully facially engageable with the skating surface both when said pad is new and as said pad becomes worn;

said break pad including front and rear pad portions and further includes control means for controlling abrasive wear of said pad during operation, said control means being disposed at said rear pad portion such that said rear pad portion abrades relative to said front pad portion so that said pad braking surface progressively engage the skating surface from said trailing edge to said leading edge during braking substantially throughout the use-life of said pad; and said control means for controlling abrasive wear comprises a pair of relief apertures extending upwardly into said pad from said braking surface.

29. The brake of claim 28 wherein said apertures are disposed substantially symmetrically with respect to the common plane of rotation.

30. The brake of claim 28 wherein said apertures each have a crescent shaped cross-sectional configuration.

31. The brake of claim 28 wherein during coasting said braking surface and a line drawn substantially tangent to said rearwardmost wheel and substantially intersecting said trailing edge of said brake pad form an angle in the range of about three to five degrees.

32. A brake and an in-line roller skate, the skate being useable by a skater on a skating surface and including a frame mounting a plurality of wheels in a common plane of rotation and further including means for attaching the frame to a skater's foot, said brake being engaged upon the skating surface by the skater pivoting the skate about the rearwardmost of the wheels to engage the skating surface so as to apply a braking force, said brake comprising:

a brake pad formed of at least one compressible material, said brake pad further including a braking surface engageable with the skating surface as said skate is pivoted about the rearwardmost wheel, said braking surface including a leading edge and a trailing edge; and attaching means for attaching said brake pad to the skate rearwardly of the rearwardmost wheel such that said trailing edge engages the skating surface before said leading edge when said brake is applied;

wherein during braking, said engagement of said brake pad with the skating surface begins at said trailing edge of said brake pad braking surface upon the initial application of the braking force as the skate is pivoted, and wherein the fractional portion of said braking surface engaging the skating surface progressively increases from the trailing edge to the leading edge as the skate is further pivoted and the applied braking force is increased until said pad braking surface substantially fully facially engages the skating surface;

wherein said brake pad braking surface is fully facially engageable with the skating surface both when said pad is new and as said pad becomes worn;

said break pad including front and rear pad portions and further includes control means for controlling abrasive wear of said pad during operation, said control means being disposed at said rear pad portion such that said rear pad portion abrades relative to said front pad portion so that said pad braking surface progressively engages the skating surface from said trailing edge to said leading edge during braking substantially throughout the use-life of said pad; and said read pad portion includes a rear upper portion and wherein said means for controlling abrasive wear comprises a pair of relief apertures extending through said pad transverse to the common plane of rotation, said apertures being disposed in said pad in the rear upper portion thereof.

33. The brake of claim 32 wherein one of said apertures has a substantially oval cross-sectional configuration and the other one of said apertures has a substantially semi-oval cross-sectional configuration.

* * * * *

UNITED STATES PATENT AND TRADEMARK OFFICE

CERTIFICATE OF CORRECTION

PATENT NO. : 5,253,883

DATED : October 19, 1993

INVENTOR(S) : Paul G. Moldenhauer

It is certified that error appears in the above-identified patent and that said Letters Patent is hereby corrected as shown below:

Column 8, line 18 "ar" should read --are--.

Column 13, line 37 "a" should read --as--.

Column 14, line 46 "front and rear" should read --rear and forward--.

Column 15, line 9 "with" should read "upon".

Column 16, line 6 "front and rear" should read --rear and forward--.

Column 16, line 41 "front and rear" should read --rear and forward--.

Column 18, line 58 "apertures" should read --aperture--.

Column 19, line 15 delete "rearwardly and downwardly after the word "skate".

Column 19, line 16 insert --to engage the skating surface so as-- after the word "wheels".

Column 19, line 49 delete "surface" after the word "braking".

Column 19, line 50 insert --so as to achieve said progressive engagement of said braking surface-- after the word "braking".

UNITED STATES PATENT AND TRADEMARK OFFICE

CERTIFICATE OF CORRECTION

PATENT NO. : 5,253,883

DATED : October 19, 1993

INVENTOR(S) : Paul G. Moldenhauer

It is certified that error appears in the above-identified patent and that said Letters Patent is hereby corrected as shown below:

Column 20, line 22 "break" should read --brake--.

Column 21, line 14 "engage" should read --engages--.

Column 21, line 24 insert --relief-- after the word "said".

Column 22, line 23 "break" should read --brake--.

Column 22, line 33 "read" should read --rear--.

Signed and Sealed this

Seventh Day of June, 1994

*Attest:*

Bruce Lehman

BRUCE LEHMAN

*Attesting Officer*

*Commissioner of Patents and Trademarks*